US005732449A

United States Patent [19]

Nelson et al.

[11] Patent Number: 5,732,449

[45] Date of Patent: Mar. 31, 1998

[54] STRAP RETAINING DEVICE FOR A FASHION ACCESSORY

[76] Inventors: Roger Nelson; Martin Terzian, both of 1241 Old Temescal Rd., Bldg. 102, Corona, Calif. 91719

[21] Appl. No.: 705,090

[22] Filed: Aug. 29, 1996

[51] Int. Cl.[6] ..... A44B 11/00; A44B 11/04

[52] U.S. Cl. ..... 24/200; 24/199; 24/545

[58] Field of Search ..... 24/198, 199, 200, 24/169, 307, 318

[56] References Cited

U.S. PATENT DOCUMENTS

| | | | |
|---|---|---|---|
| 2,095,340 | 10/1937 | Meyer | 24/198 |
| 2,099,199 | 11/1937 | Devendor et al. | 24/198 |
| 2,212,862 | 8/1940 | Hirsh | 24/200 |
| 2,278,153 | 3/1942 | Shaulson | 24/200 |
| 2,293,562 | 8/1942 | Rosenthal | 24/200 |
| 2,380,297 | 7/1945 | Dilbert . | |
| 2,656,918 | 10/1953 | Holllis | 248/902 X |
| 3,177,541 | 4/1965 | Derrickson | 24/200 |
| 3,218,686 | 11/1965 | Rubenstein | 24/198 |
| 3,222,688 | 12/1965 | Rosenzweig | 24/200 X |
| 3,252,191 | 5/1966 | Mezerenyl et al. | 24/318 |
| 3,623,689 | 11/1971 | Johnston | 248/902 X |
| 3,967,347 | 7/1976 | Bickis, Sr. | 24/200 |
| 4,077,091 | 3/1978 | Liljedahl | 24/198 |
| 4,457,051 | 7/1984 | Bartolini | 24/198 |
| 4,821,934 | 4/1989 | Alessi et al. | 24/3.3 |
| 4,903,375 | 2/1990 | DiFranco | 24/3.12 X |
| 4,930,740 | 6/1990 | Vogt | 24/17 AP X |
| 5,353,481 | 10/1994 | Farris, Jr. | 24/545 |
| 5,590,443 | 1/1997 | Fildan | 24/200 |

FOREIGN PATENT DOCUMENTS

| | | | |
|---|---|---|---|
| 505530 | 5/1939 | United Kingdom | 24/200 |

*Primary Examiner*—Peter M. Cuomo
*Assistant Examiner*—Robert J. Sandy
*Attorney, Agent, or Firm*—Longacre & White

[57] ABSTRACT

A display device for a fashion accessory that includes an elongated strap of a purse or similar bag and a retaining member that receives a strap in a looped form and retains the strap in its desired position. The retaining member receives and retains the strap in its desired position without slippage by providing a unitary body defining a retaining plane parallel to the plane of the strap, wherein apertures are disposed on and passing through this retaining plane. In the preferred embodiments of this invention, the retaining device takes the forms of a figure-eight or S-shaped design. Moreover, breakaway tabs may be provided to enhance the frictional resistance to slippage.

15 Claims, 2 Drawing Sheets

STRAP RETAINING DEVICE FOR A FASHION ACCESSORY

BACKGROUND OF THE INVENTION a) Field of the Invention

The present invention relates to a display device for a fashion accessory that includes an elongated strap of a purse or any similar article that utilizes a strap. More specifically, the present invention permits a bag or series of bags to be hung at a predetermined and uniform position on a display unit. The strap retaining device receives a folded strap in a looped form and retains the strap in its desired position.

b) Description of Related Art

Purses, assorted handbags and other fashion accessories that utilize straps are often displayed in a hanging manner on a display device. Difficulty may be encountered in placing and supporting these accessories on the display device in a uniform manner. Typically, the purses, handbag or other accessory that utilizes an elongated strap overlap, become entangled and otherwise displaced on the display device. In this instance, the effectiveness of the device display is reduced when the uniformity of the handbag arrangement is disrupted.

FIGS. 1–4 illustrates a conventional device that attempts to overcome the aforementioned drawbacks. With the device 10 of FIG. 1, a strap 12 of a handbag is inserted into a slot defined between a base portion 10*a* and a raised arm 10*b*. The strap is thus effectively shortened by the device 10 in order to facilitate display of the handbag in a retail shop (see FIG. 2). FIG. 3 shows a modified design of the device 10 of FIG. 1. The device 10 of FIG. 3 is modified such that the raised arm 10*b* is cantilevered to permit attachment to the strap 12 at an intermediate portion thereof. FIG. 4 provides a side view of the device 10 shown in FIGS. 1–3 and described above.

The conventional device 10 however suffers from the drawback that it tends to slip along the longitudinal length of the strap 12. Because the purpose of the device 10 of FIGS. 1–4 is to retain the handbag at a preset height, the purpose is defeated if the strap is permitted to slip.

The need therefore exists for a retaining device which suitably retains handbags and other articles having a strap on a display device without slippage. Moreover, such an improved device must be easily applied to, adjusted and retained on the strap.

SUMMARY OF THE INVENTION

It is the object of the present invention to provide a display device for a fashion accessory that includes an elongated strap of a purse or similar bag. More specifically, it is the object of the present invention to permit a bag or series of bags to be hung at a predetermined and uniform position on a display unit without slippage.

The strap retaining device according to this invention receives a folded strap in a looped form and retains the strap in its desired position without slippage by providing a unitary body defining a retaining plane parallel to the plane of the strap, wherein apertures are disposed on and passing through this retaining plane. In the preferred embodiments of this invention, the retaining device takes the forms of a figure-eight or S-shaped design. Moreover, breakaway tabs may be provided to enhance the frictional resistance to slippage.

As will become apparent from the description to follow, the present invention may take a number of particular shapes and forms without departing from the spirit and intent of the invention which provides a novel retaining device for handbags that eliminates unwanted slippage.

DETAILED DESCRIPTION OF THE PREFERRED EMBODIMENTS

Figure 5:
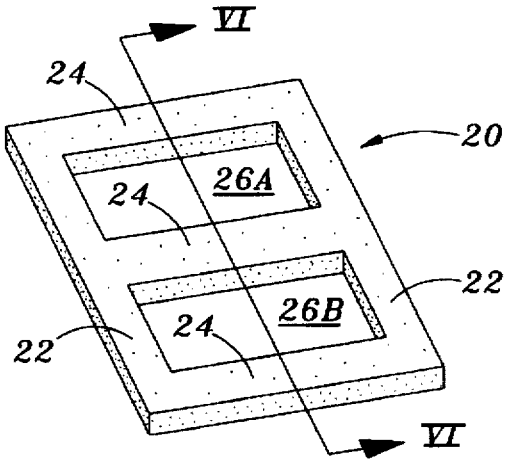
FIG. 5 is a perspective view of a first embodiment of the retaining device according to the present invention.

FIG. 5 illustrates the first embodiment of the retaining device 20 of this invention, wherein a figure-eight design is employed. The device 20 comprises a unitary body in the form of a figure-eight having longitudinal side walls 22 extending parallel to one another. Extending transverse to the side walls 22 are friction bars 24. The longitudinal side wall 22 and transverse friction bars 24 define two apertures 26*a* and 26*b* passing through the retaining device 20. These two apertures 26*a*, 26*b* receive the strap 12 of a handbag or other bag having a similar elongated strap.

Figure 6:
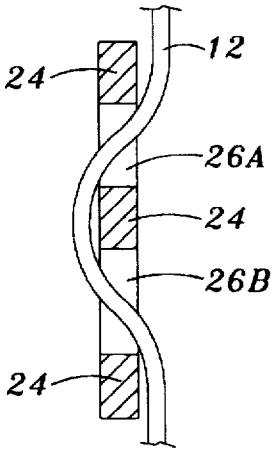
FIG. 6 is a cross sectional view of the retaining device of FIG. 5 taken along line VI—VI.

FIG. 6 shows the retaining device 20 of FIG. 5 in cross section with the strap 12 extending along the retaining plane defined by the device 20, passing into the first aperture 26*a* in a first direction, and reversing direction to subsequently pass through the second aperture 26*b* in a second direction opposite to the first direction.

Because the retaining device 20 of this invention is formed along a single retaining plane as best illustrated in FIG. 6 with apertures 26*a*, 26*b* passing therethrough, the strap 12 of a handbag or other fashion accessory can be suitably retained without slippage. With this design, the strap is woven through the two apertures of the retaining device 20 in manner to prevent slippage. Please note that the exterior surfaces of the friction bars 24 may be suitably roughened or otherwise treated to enhance the friction coefficient for these surfaces; such treatment will further reduce slippage.

Figure 7:
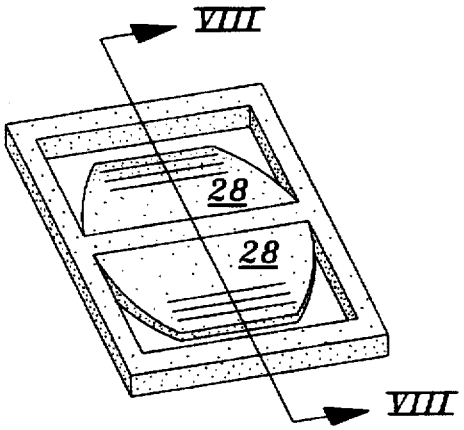
FIG. 7 is a perspective view of a second embodiment of the invention wherein the first embodiment is formed with breakaway tabs.
Figure 8:
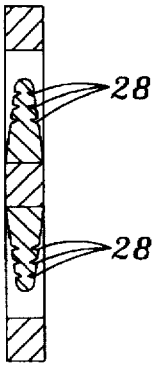
FIG. 8 is a cross sectional view of the retaining device of FIG. 7 taken along line VIII—VIII.

FIGS. 7 and 8 illustrate a modified embodiment of this invention wherein breakaway fracture tabs 28 extend into at least one of the apertures 26*a*, 26*b*. The fracture tabs 28 comprises weakened fracture zones 28*a* to permit the fracture tab to be shortened or removed. With this arrangement, the size of the aperture 26*a*, 26*b* may be varied to fit straps of different sizes.

Figure 9:
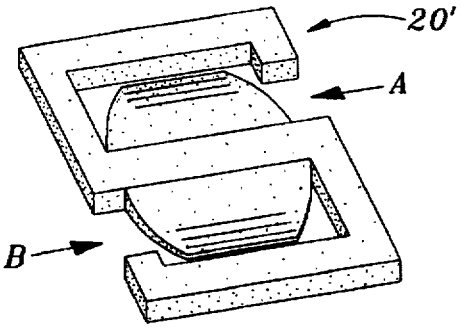
FIG. 9 is a perspective view of a third embodiment of the retaining device according to the present invention.

FIG. 9 illustrates a further modified embodiment of this invention wherein the retaining device 20' is formed as an S-shaped body in order that the strap 12 may be inserted into the apertures 26a, 26b in the directions shown by arrows A and B in FIG. 9. Aside from the modified side walls 22 having the passages at arrows A and B of FIG. 9, the structure and operation of the retaining device 20' is the same as the device shown in FIGS. 5–8 and described above. The modified design of FIG. 9 serves to reduce assembly time, particularly for lengthy straps. It is also noted that the fracture tabs 28 may also be provided on the S-shaped device 20' of FIG. 9.

Figure 2:
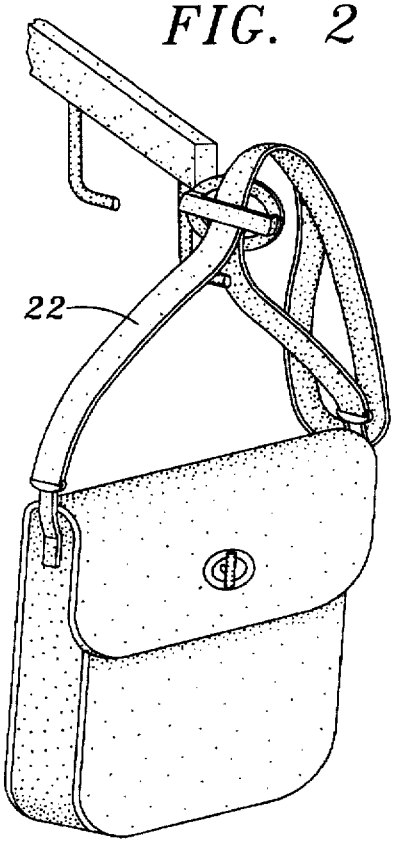
FIG. 2 illustrates a handbag utilizing the device of FIG. 1.
Figure 1:
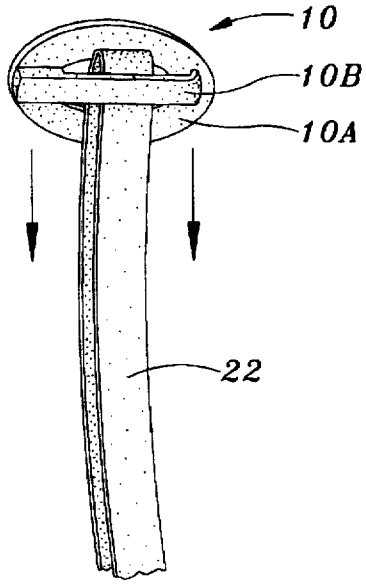
FIG. 1 illustrates a conventional strap retaining device being affixed to a strap.
Figure 3:
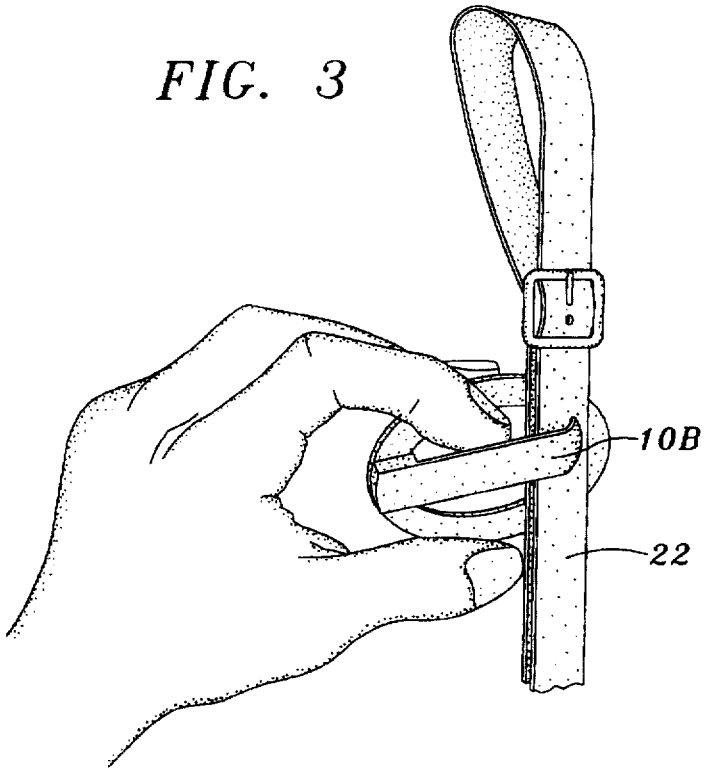
FIG. 3 illustrates another conventional retaining device being affixed to a strap.
Figure 4:
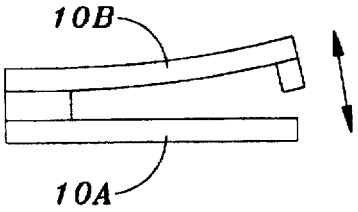
FIG. 4 is a side view of the retaining device of FIG. 3.
Figure 10:
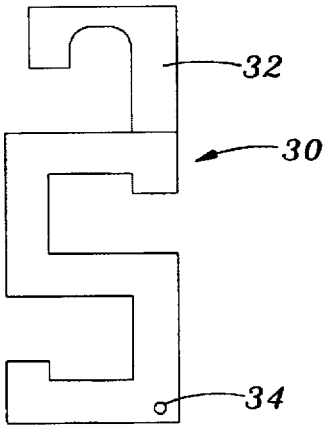
FIG. 10 is a modification of the retaining device of FIG. 8 having a hook to facilitate hanging on a display device.

FIG. 10 illustrates a further embodiment wherein a secondary hook 32 is formed on the retaining device 30 to enable the retaining device and accompanying handbag to be easily hung from a standard display rack in the manner illustrated in prior art FIG. 2, but without the strap slippage customary with the prior art device of FIG. 2. Further, the retaining device of this invention may be formed with an additional aperture for receiving a price tag of other hanging tag.

It will be understood by those possessing skill in the art that the size and strength of the side walls 22 and friction bars 24 will vary depending on the width and thickness of the straps 12 to be retained, and the weight of the particular handbag at issue. All of the holders disclosed herein may have a hole to provide for a secure attachment or similar device which typically will hold price tags and hang tags in a commercial environment.

The retaining device described herein may be formed of numerous materials including but not limited to cardboard, plastic, rubber, metal, wood; the selection of the particular material would depend on its utility and appearance. Recyclable material should be preferred whenever possible.

It is also noted that this invention is not limited to handbags and the like, but is intended for use with any article that utilizes a strap, i.e. binoculars, sunglasses, carrying cases for cameras or other similar articles.

What is claimed is:

1. A retaining device for frictionally coupling an elongated strap at a predetermined position along its length, said retaining device comprising:

a pair of side walls extending a longitudinal direction, at least three transverse friction bars extending transverse to said pair of side walls, said transverse friction bars being offset from each other to thereby define at least two discrete apertures at least partially circumscribed by said side walls and said friction bars, and at least one fracture tab disposed within at least one of said apertures, said at least one fracture tab comprising a fracture zone for selective removing at least a portion of said fracture tab from said at least one aperture;

wherein said side walls and said friction bars are dimensioned to define at least one retaining plane, and said at least two apertures pass through said retaining plane.

2. The retaining device according to claim 1, wherein said side walls and said friction bars form a figure-eight configuration.

3. The retaining device according to claim 1, wherein said side walls and said friction bars form an S-shaped configuration.

4. The retaining device according to claim 1, further comprising at least one fracture tab disposed within at least one of said apertures.

5. The retaining device according to claim 1, wherein said friction bars comprise a treated exterior surface that increases a frictional coefficient of said friction bars.

6. The retaining device according to claim 1, further comprising a separate hook member projecting from one of said side walls and said friction bars for hanging said device from a display device.

7. A combination of a retaining device and an elongated strap for supporting a handbag, said retaining device being frictionally coupled to said elongated strap at a predetermined position along its length, said retaining device comprising:

at least three transverse friction bars extending transverse to an elongated length of said strap, said transverse friction bars being offset from each other to thereby define at least two discrete apertures at least partially circumscribed by said friction bars, and at least one fracture tab disposed within at least one of said apertures, said at least one fracture tab comprising a fracture zone for selective removing at least a portion of said fracture tab from said at least one aperture;

wherein said strap passes into a first aperture of said at least two aperture in a first direction and into a second of said at least two aperture in a second direction opposite to said first direction.

8. The combination of retaining device and strap according to claim 7, wherein said friction bars are disposed on a single plane.

9. The combination of retaining device and strap according to claim 7, wherein said friction bars are disposed parallel to one another.

10. The combination of retaining device and strap according to claim 7, further comprising side walls connected to said friction bars.

11. The combination of retaining device and strap according to claim 10, wherein said side walls and said friction bars form a figure-eight configuration.

12. The combination of retaining device and strap according to claim 10, wherein said side walls and said friction bars form an S-shaped configuration.

13. The combination of retaining device and strap according to claim 7, further comprising at least one fracture tab disposed within at least one of said apertures.

14. The combination of retaining device and strap according to claim 7, wherein said friction bars comprise a treated exterior surface that increases a frictional coefficient of said friction bar.

15. The combination of retaining device and strap according to claim 7, further comprising a separate hook member projecting from one of said side walls and said friction bars for hanging said device from a display device.

* * * * *